US011815337B2

(12) United States Patent
Scharpenack

(10) Patent No.: US 11,815,337 B2
(45) Date of Patent: Nov. 14, 2023

(54) BALLISTIC PROTECTIVE HELMET

(71) Applicant: Ulbrichts GmbH, Schwanenstadt (AT)

(72) Inventor: Georg Scharpenack, Oberösterreich (AT)

(73) Assignee: Ulbrichts GmbH, Schwanenstadt (AT)

( * ) Notice: Subject to any disclaimer, the term of this patent is extended or adjusted under 35 U.S.C. 154(b) by 568 days.

(21) Appl. No.: 16/263,260

(22) Filed: Jan. 31, 2019

(65) Prior Publication Data

US 2019/0234711 A1 Aug. 1, 2019

(30) Foreign Application Priority Data

Jan. 31, 2018 (DE) ..... 20 2018 000 496.0
Jan. 31, 2018 (EP) ..... 18154496

(51) Int. Cl.
*A42B 3/06* (2006.01)
*F41H 1/04* (2006.01)
*F41H 1/08* (2006.01)

(52) U.S. Cl.
CPC ..... *F41H 1/08* (2013.01); *A42B 3/063* (2013.01); *F41H 1/04* (2013.01)

(58) Field of Classification Search
CPC ..... F41H 1/04; F41H 1/06; F41H 1/08; F41H 5/0421; F41H 5/0414; F41H 5/0457; F41H 5/0464; A42B 3/003; A42B 3/04; A42B 3/063
USPC ..... 2/6.6, 410–412, 416, 422
See application file for complete search history.

(56) References Cited

U.S. PATENT DOCUMENTS

| | | | | |
|---|---|---|---|---|
| 3,789,427 | A | 2/1974 | Aileo | |
| 3,871,026 | A | 3/1975 | Dörre | |
| 5,035,952 | A | 7/1991 | Bruinink et al. | |
| 6,378,140 | B1 * | 4/2002 | Abraham | A42B 3/064 2/411 |
| 2012/0180634 | A1 * | 7/2012 | Kirkham | F41H 1/04 89/36.05 |
| 2013/0031700 | A1 * | 2/2013 | Wacter | A42B 3/322 2/411 |
| 2013/0047309 | A1 | 2/2013 | Strum | |
| 2013/0086722 | A1 | 4/2013 | Teetzel et al. | |
| 2013/0247281 | A1 * | 9/2013 | Zebouni | A42C 5/02 2/272 |

(Continued)

FOREIGN PATENT DOCUMENTS

| | | | |
|---|---|---|---|
| CH | 666344 | A5 | 7/1988 |
| CN | 107529847 | A | 1/2018 |

(Continued)

OTHER PUBLICATIONS

International Search Report and Written Opinion for corresponding Patent Application No. PCT/EP2019/051995 dated Apr. 23, 2019.

(Continued)

*Primary Examiner* — Jameson D Collier
(74) *Attorney, Agent, or Firm* — Renner, Otto, Boisselle & Sklar, LLP

(57) ABSTRACT

A ballistic protective helmet including a helmet dome formed from a metal material, wherein the helmet dome has an inside facing the head of the wearer and an opposite outside. The ballistic protective helmet further includes a layer arranged on the outside of the helmet dome, which layer is formed from a fiber composite material.

11 Claims, 6 Drawing Sheets

(56) References Cited

U.S. PATENT DOCUMENTS

Figure 1A:
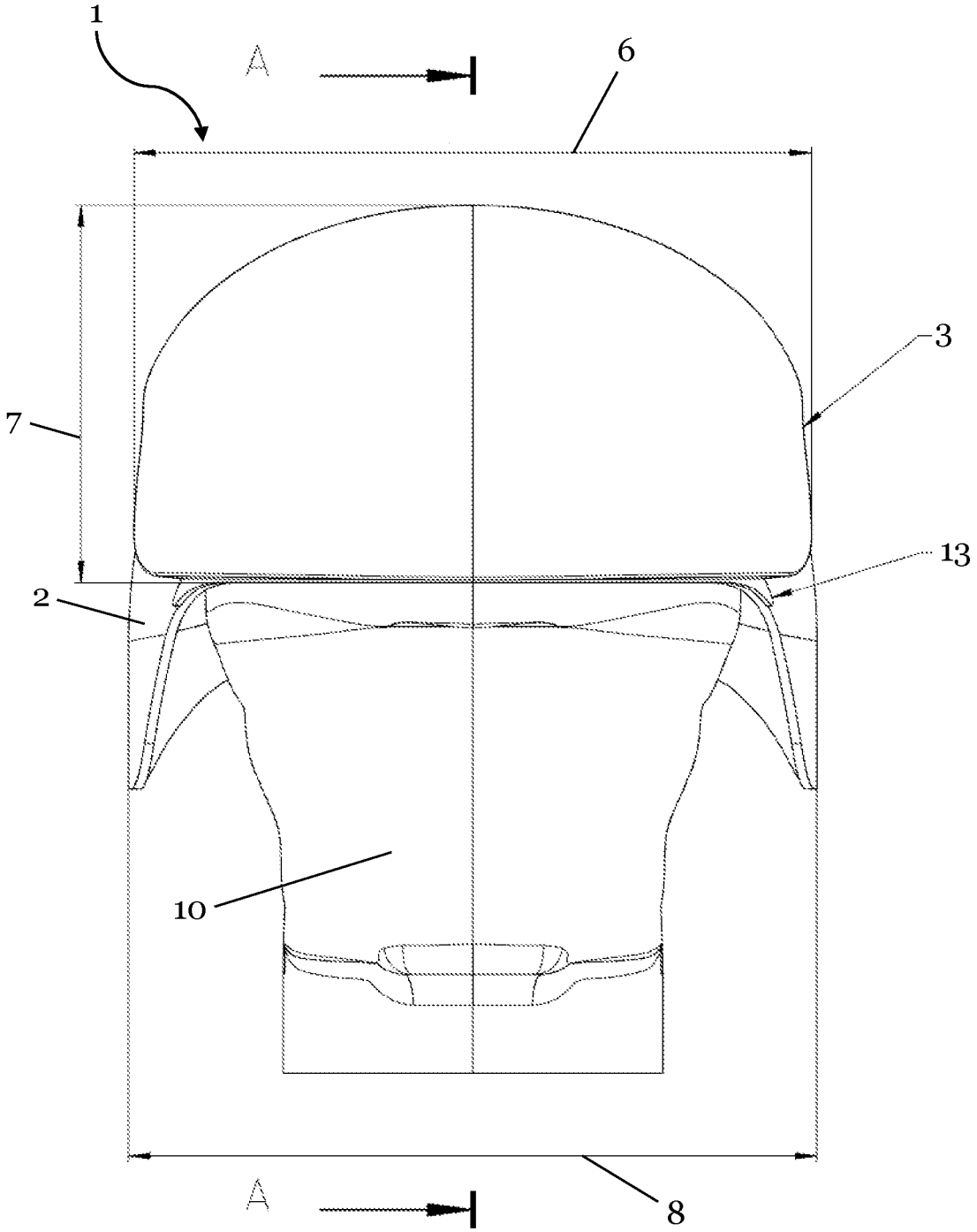

| | | | | |
|---|---|---|---|---|
| 2014/0115745 | A1 | 5/2014 | Martinez | |
| 2014/0123360 | A1* | 5/2014 | Cohen | A42B 3/003 2/6.6 |
| 2014/0359911 | A1 | 12/2014 | Strum | |
| 2015/0026872 | A1* | 1/2015 | Giroux Bernier | A42B 3/30 29/428 |
| 2016/0270471 | A1* | 9/2016 | Merrell | A42B 3/121 |
| 2018/0153243 | A1* | 6/2018 | Pradeep | A42B 3/064 |

FOREIGN PATENT DOCUMENTS

| | | |
|---|---|---|
| DE | 199 61 371 A1 | 7/2001 |
| JP | 2000160423 | 6/2000 |

OTHER PUBLICATIONS

Examination Report No. 2 for Standard Patent Application issued for corresponding Australian Application No. 2019215711, dated Feb. 24, 2022.

Original and English Translation of Chinese Office Action issued for corresponding Chinese Patent Application No. 201980011105.8, dated Aug. 1, 2022.

* cited by examiner

BALLISTIC PROTECTIVE HELMET

This application claims priority to European Patent Application No. 18154496.6 filed on Jan. 31, 2018 and German Patent Application No. 20 2018 000 496.0 filed on Jan. 31, 2018, which are hereby incorporated herein by reference.

1. TECHNICAL FIELD

The present invention relates to a ballistic protective helmet.

2. PRIOR ART

A ballistic protective helmet protects the head of its wearer from direct firing with firearms but also from splinters and the impact of cutting or thrust weapons. Such helmets are therefore worn for self-protection by special operations forces and increasingly also by policemen arriving on site first (so-called "first responders").

The fundamental protective effect of a protective helmet consists in stopping an impinging projectile (such as a bullet or a splinter) and preventing the projectile from penetrating the head of a wearer of the protective helmet. Another important aspect of the protective effect consists in keeping the impact of the kinetic energy of the projectile onto the head of the wearer as low as possible. In particular, the intention is to prevent the protective helmet from being dented by the projectile to an extent where considerable residual energy impacts on the head. This is a problem especially in the edge area of the helmet as the edge tends to bend inwards under fire.

In the prior art, helmets from aramid and/or polyethylene are known, which, however, primarily offer protection from splinters and, particularly under direct fire with bullets (from hand weapons), do not have sufficient protective effect, because under fire with bullets, they are prone to severe deformation that causes an impact of residual energy on the head which is often lethal. Especially in an edge area with a width of up to 30 mm, the edge bends in such a way that a projectile can pass and directly wound the head. In the case of fire above this edge area (up to approximately 50 mm), the helmet is usually deformed in such a way that considerable residual energy impacts on the head. Aramid/polyethylene helmets are therefore primarily suitable as a protection from splinters and less under bullet fire.

Titanium helmets prove to be much more effective under fire as they are capable of transforming the kinetic energy of the projectile into plastic deformation over a larger area, and the helmet is therefore not deformed inwards to an extent where the head suffers a deadly impact. Moreover, such helmets have a deflective effect on the projectile and/or its splinters, so that not the entire momentum of the projectile is transferred to the helmet. These two effects are particularly noticeable in the edge area. The effective protective area of a titanium helmet is therefore considerably larger than that of an aramid/polyethylene helmet.

Basically, with regard to any type of ballistic protective helmet, the aim is to improve the protective effect of the helmet against external ballistic impacts, i.e. to prevent a lethal effect in the case of higher kinetic energies/energy densities of the projectile (caused by larger mass and/or higher impact velocity). Protective helmets known in the art for use by special forces and the police can only offer protection against bullets (or splinters of equivalent kinetic energy) fired from handguns. They do not offer any protection against long guns. The term long gun refers to a gun whose barrel including the breech exceeds a certain length (for example 300 mm). Alternative definitions of long guns use as a basis the total length of the gun (for example 600 mm). According to the definition, handguns are all other guns. Long gun bullets have higher muzzle velocities and oftentimes harder materials (for example iron instead of lead) with a higher penetration effect. The kinetic energy of long gun bullets is usually higher than that of handgun bullets.

3. SUMMARY OF THE INVENTION

Therefore, the aim of the invention is to improve the ballistic protective helmets known in the art, particularly those for special forces and the police, in such a way that they offer sufficient protective effect when fire with projectiles of higher kinetic energy, especially from long guns, is expected. At the same time, the weight of the helmets should not be increased to an extent where the wearing comfort and the handleability are considerably impaired.

According to a first aspect of the present invention, this aim is achieved with a ballistic protective helmet, comprising (a.) a helmet dome formed from a metal material, wherein the helmet dome comprises an inside facing the head of a wearer and an opposite outside; and (b.) a layer arranged on the outside of the helmet dome, which layer is formed from a fiber composite material.

The inventors have recognized that the protective effect of metal helmets such as titanium helmets known in the art can be considerably improved if the projectile hits a layer made from fiber composite material first and the helmet dome made from metal. Such a combination of materials prevents lethal deformations of the helmet dome also in the case of projectiles of higher kinetic energy, i.e. of larger mass (caliber) and/or impact velocity, especially of the kind to be expected under fire from a long gun.

Surprisingly, this effect is achieved by the fiber composite material being arranged on the outside of the helmet dome, because according to an opinion common among experts, this does not result in a considerable improvement as according to this opinion, soft material on a hard material would only be punched by the impacting bullet. Therefore, if protective helmets known in the art comprise soft and hard materials, the soft material is arranged under the hard material in order to prevent the assumed "punching". The tests carried out by the inventors show that in the combination of fiber composite material and an underlying metal dome, punching does not occur, but unexpectedly, considerably better protection is achieved, even against fire from long guns.

In the scope of this disclosure, protective effect refers to the capability of a ballistic protective helmet to receive and/or deflect the momentum of an impinging projectile in such a way that the bullet does not penetrate the head of a wearer and the energy acting on the head due to deformation of the helmet remains under a particular threshold value that is usually considered lethal. A protective helmet with a higher protective effect than another protective helmet can therefore protect the head against a projectile of higher kinetic energy and/or penetration effect. In any case, a projectile has a higher kinetic energy than another projectile if its mass and/or velocity is higher. In general, the kinetic energy is the product of mass and velocity squared divided by two.

The protective effect achieved by the combination of the metal dome and the fiber composite layer in this regard exceeds the total protective effects of metal and fiber composite material, considered individually, to an unexpected extent. According to the invention, the weight of the helmet according to the invention, compared to prior art helmets, does not increase in proportion to the achieved protective effect but reaches an acceptable level. The same applies to the wearing comfort and the handleability. For example, in a helmet according to the invention, compared to a prior art helmet, an excellent protective effect under fire with a projectile of at least three times the kinetic energy can be achieved by doubling the unit per area. Therefore, the invention is not a compromise between protective effect on the one hand and weight, wearing comfort and handleability on the other hand. Rather, the invention achieves an unexpected synergistic effect; above all, protection against fire from long guns by comparatively light-weight helmets is provided for the first time.

The layer may substantially cover the entire outside of the protective helmet. In a preferred embodiment, the layer covers more than 80%, more preferably more than 90% and even more preferably more than 95% of the outside of the protective helmet. This way, the protective helmet can take its full protective effect against fire from all directions.

The layer may be firmly connected to the helmet dome. For example, the layer may be glued to the helmet dome with an adhesive. Furthermore, the layer may be formed in one part. In an alternative embodiment, the layer consists of two or more parts. The two or more parts may be arranged on the helmet dome such that they abut each other. This way, a substantially uninterrupted layer of fiber composite material consisting of several segments can be formed from two or more parts. For example, a segment may be arranged in the forehead area, a segment on the left side and a segment on the right side of the helmet.

Another aspect of the present invention relates to a ballistic protective helmet, comprising (a.) a helmet dome formed from a metal material, wherein the helmet dome comprises an inside facing the head of a wearer and an opposite outside; and (b.) a first mounting means arranged on the outside of the helmet dome, which mounting means is designed such that a layer from fiber composite material may be removably mounted on the outside of the helmet dome.

According to the first and the second aspects of the present invention, the layer may thus be removably connected to the helmet dome. This enables adapting the protective effect of the helmet depending on the situation. If, for example, fire from a long gun is expected, the layer may be mounted to the helmet dome like a shield. If fire with smaller calibers is expected, the protective helmet may be worn without the shield to reduce the weight and increase the wearing comfort. This aspect also contributes to solving the problem underlying the present invention.

The layer may have a thickness of 5 to 30 mm. Preferably, the layer has a thickness of 6 to 20 mm, further preferably, the layer has a thickness of 10 to 15 mm, further preferably of 12 mm. The inventors recognized that in these thickness ranges, the protective effect is improved very well without the weight of the helmet or its wearing comfort reaching an unacceptable level. The increase in weight caused by the fiber composite material of this thickness is more than outweighed by the considerably improved protective effect, for example against fire from long guns.

The fiber composite material of the layer may comprise polyethylene fibers. Fiber composite material from polyethylene in combination with the helmet dome from metal proves to be excellent and reduces the residual energy acting on the head to an unexpectedly low level. Preferably, the fiber composite material therefore substantially, i.e. in more than half of all types of fibers, comprises polyethylene fibers. Further preferably, the fiber composite material comprises 90% polyethylene fibers.

Apart from fibers, the layer may comprise other components for binding the fibers, such as a resin or artificial resin, or solvents, or their residues.

The metal material of the helmet dome may be titanium or a titanium alloy. The inventors found that titanium has an excellent protective effect in combination with the fiber composite material of the layer.

The ballistic protective helmet according to the invention may further comprise a first mounting means designed such that the layer formed from fiber composite material may be removably mounted on the outside of the helmet dome. As already explained, this enables adapting the protective effect of the helmet depending on the situation.

In the forehead area of the helmet dome, the layer may be arranged like a shield. This increases the protective effect of the helmet, especially under frontal fire, and allows its wearer to deal more directly with the dangerous situation at lower risk.

The first mounting means may be arranged in the forehead area of the helmet dome. This enables mounting the layer in the forehead area with the advantages already mentioned.

The ballistic protective helmet may further comprise a metal strip arranged in an overlapping manner with the layer and firmly connected to the helmet dome. The metal strip may particularly be arranged in the edge area of the helmet dome. Such a metal strip additionally increases the protective effect, especially in the problematic edge area. Especially in interaction with the layer or the shield from fiber composite material, such a metal strip proves to be very advantageous.

The protective helmet may be designed such that when the helmet is being worn, the smallest distance between the inside of the helmet dome and the head of a wearer is at least 10 mm. Preferably, the distance is 10 mm to 40 mm, further preferably 15 mm to 30 mm. In interaction with the layer from fiber composite material, the distance of the helmet dome to the head has the effect that impacts on the head due to deformation of the helmet dome under fire are prevented or at least reduced.

The ballistic protective helmet according to the present invention may further comprise a headband connected to the helmet dome, which headband keeps the helmet dome at a distance to the head of a wearer when the helmet is being worn. As already mentioned, such a distance is advantageous for the protective effect. Moreover, the headband increases the wearing comfort as the protective helmet does not rest directly on the head. This way, pressure points are avoided or at least reduced, and ventilation of the head is ensured, which is advantageous especially at high temperatures.

The layer may comprise a second mounting means designed such that the layer may be removably mounted on the outside of the helmet dome. The second mounting means may be a means interacting with the first mounting means. For example, the first and the second mounting means together may form a hook-and-loop fastener. However, the first and/or the second mounting means may also be at least one button, magnet, snap-in joint or the like.

Another aspect of the present invention relates to a shield for a ballistic protective helmet, wherein the protective helmet comprises a helmet dome formed from a metal material, wherein the helmet dome comprises an inside facing the head of a wearer and an opposite outside, wherein the shield is formed from a fiber composite material and wherein the shield is designed such that it may be removably mounted on an outside of the helmet dome.

The advantages of this arrangement of fiber composite material on the outside of the helmet dome from metal material were already explained and also apply to this aspect of the invention.

The shield may be designed such that it is removably mounted to the helmet dome. This additionally enables adapting the protective effect of the helmet depending on the situation. If, for example, fire from a long gun is expected, the shield may be mounted to the helmet dome. If less of a threat is expected, the protective helmet may be worn without the shield to reduce the weight and increase the wearing comfort. This aspect also contributes to solving the problem underlying the present invention.

Removable mounting of the shield cay be achieved with the means already explained above, for example by means of a hook-and-loop fastener, buttons or magnets.

The shield may be designed such that it can be arranged in the forehead area of the helmet dome. This increases the protective effect of the helmet, especially under frontal fire, and allows its wearer to deal more directly with the dangerous situation at lower risk.

According to all aspects of the present invention, the layer or the shield from fiber composite material may have a concave surface corresponding to a convex area of the outside of the helmet dome, in which the shield is arranged. The layer or the shield thus has a negative form of the surface of the helmet dome. Between the layer or the shield and the helmet dome, only a minimal distance remains, which is substantially caused by the mounting means (for example a hook-and-loop fastener or an adhesive layer). This way, a compact ballistic protective helmet is obtained.

4. BRIEF DESCRIPTION OF THE DRAWINGS

Figure 1B:
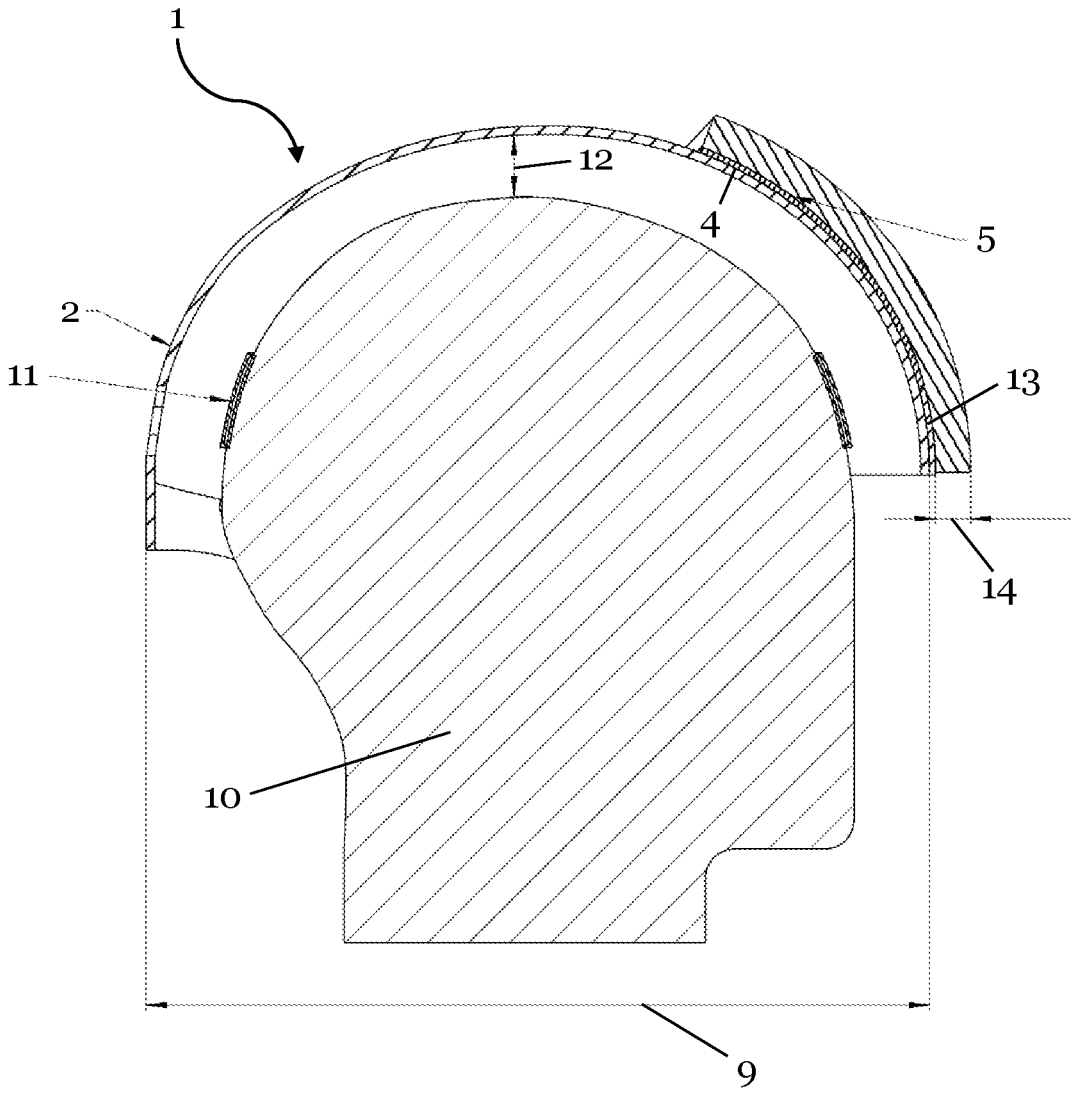
Figure 2A:
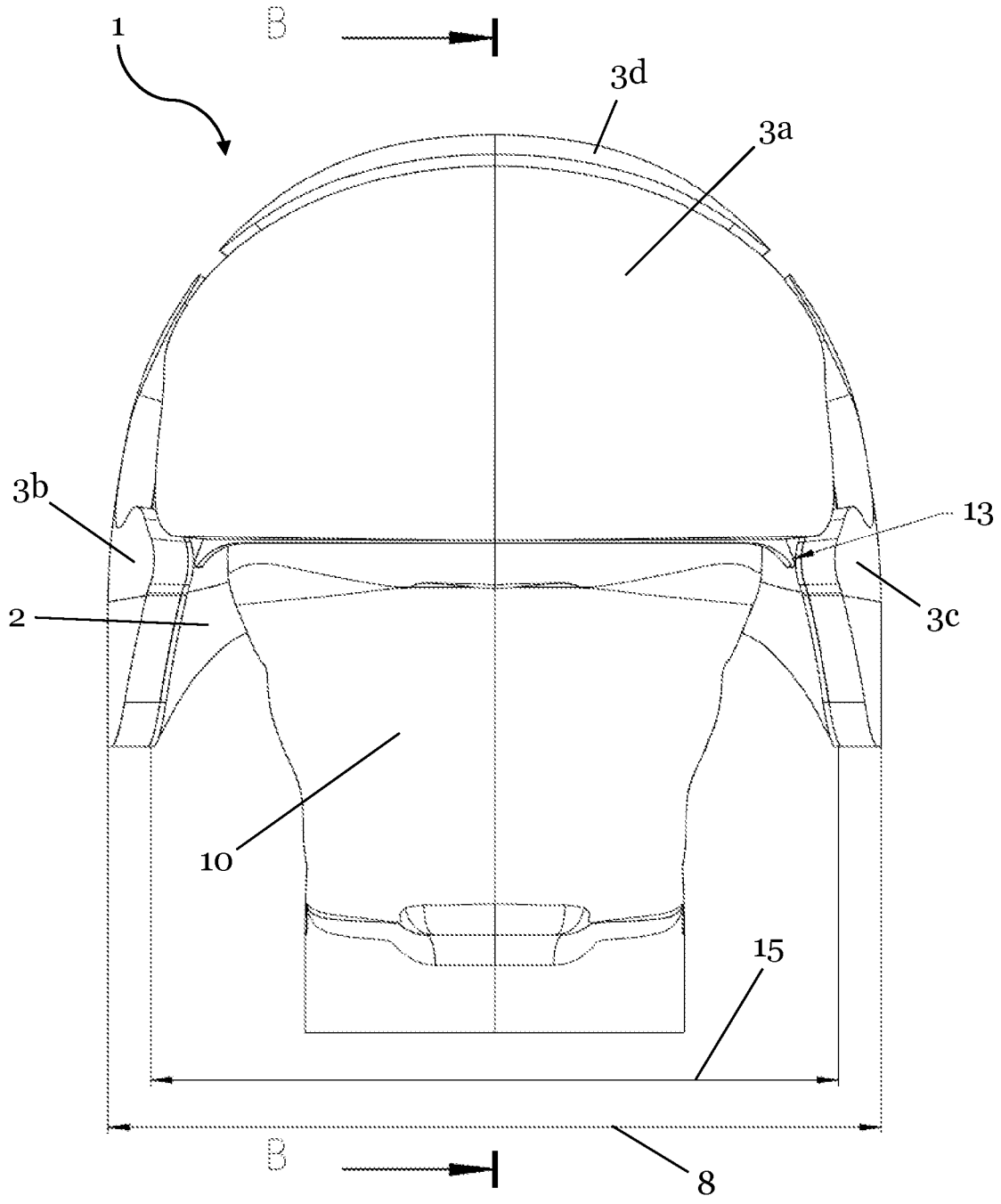
Figure 2B:
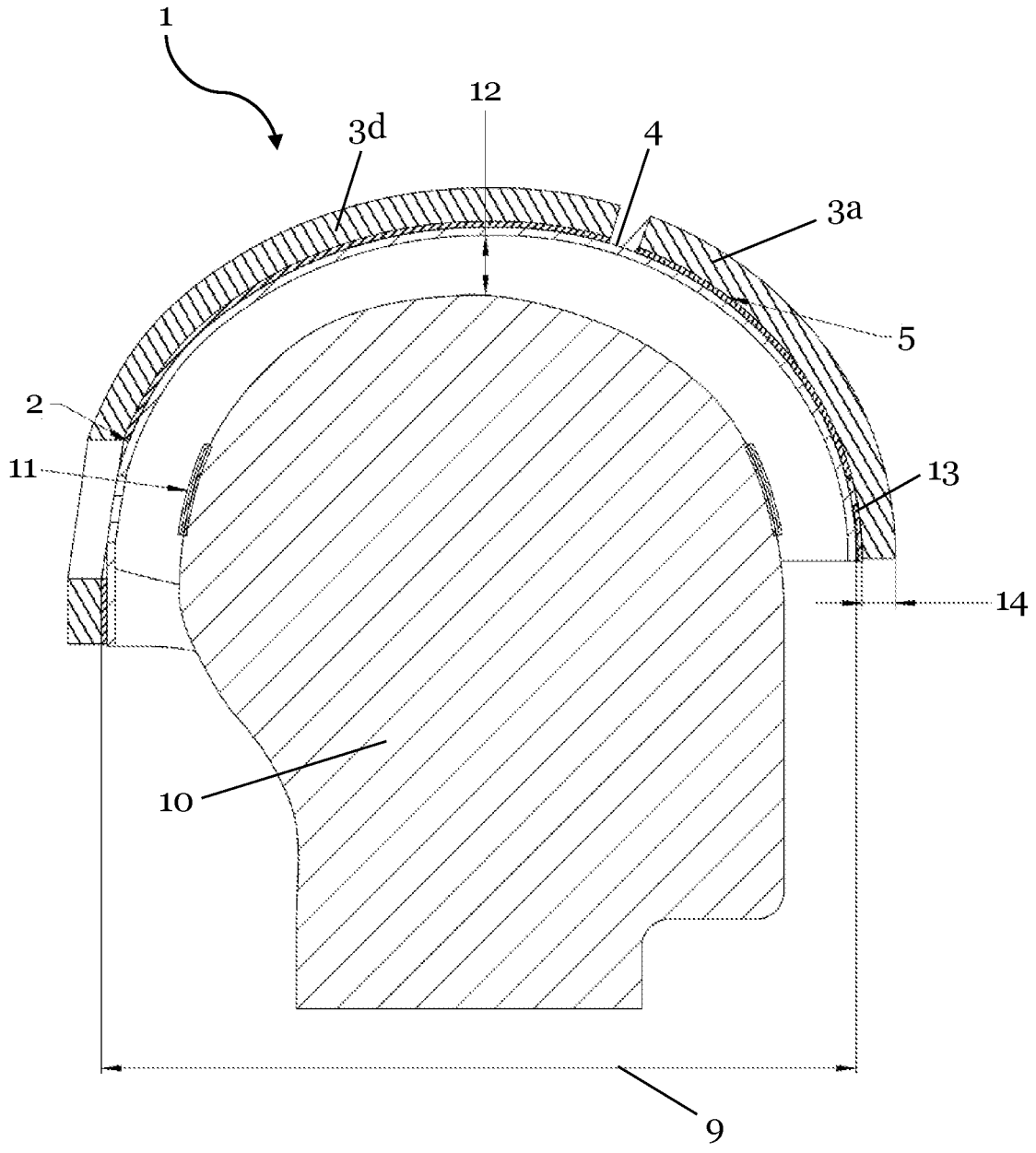
Figure 3A:
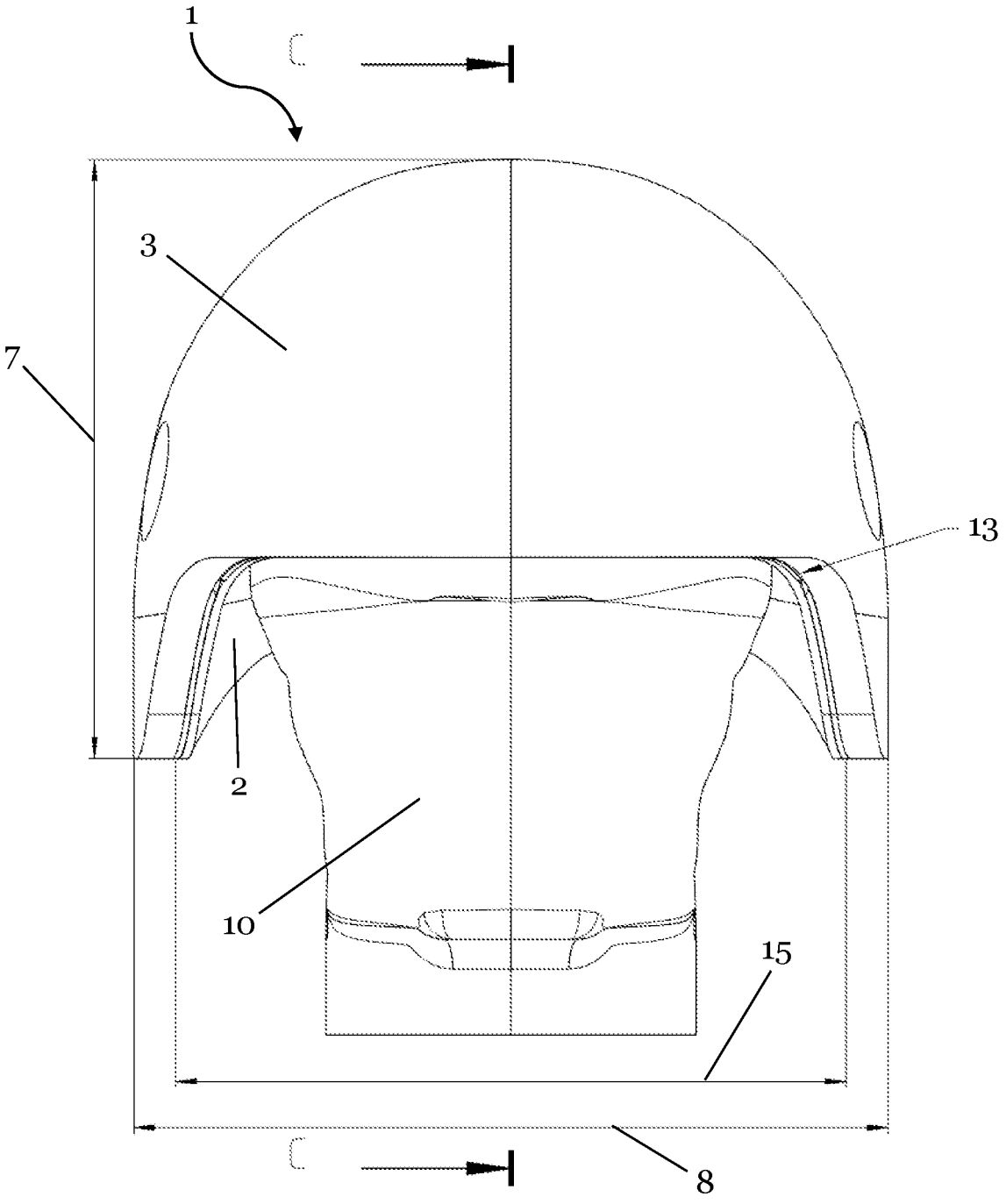
Figure 3B:
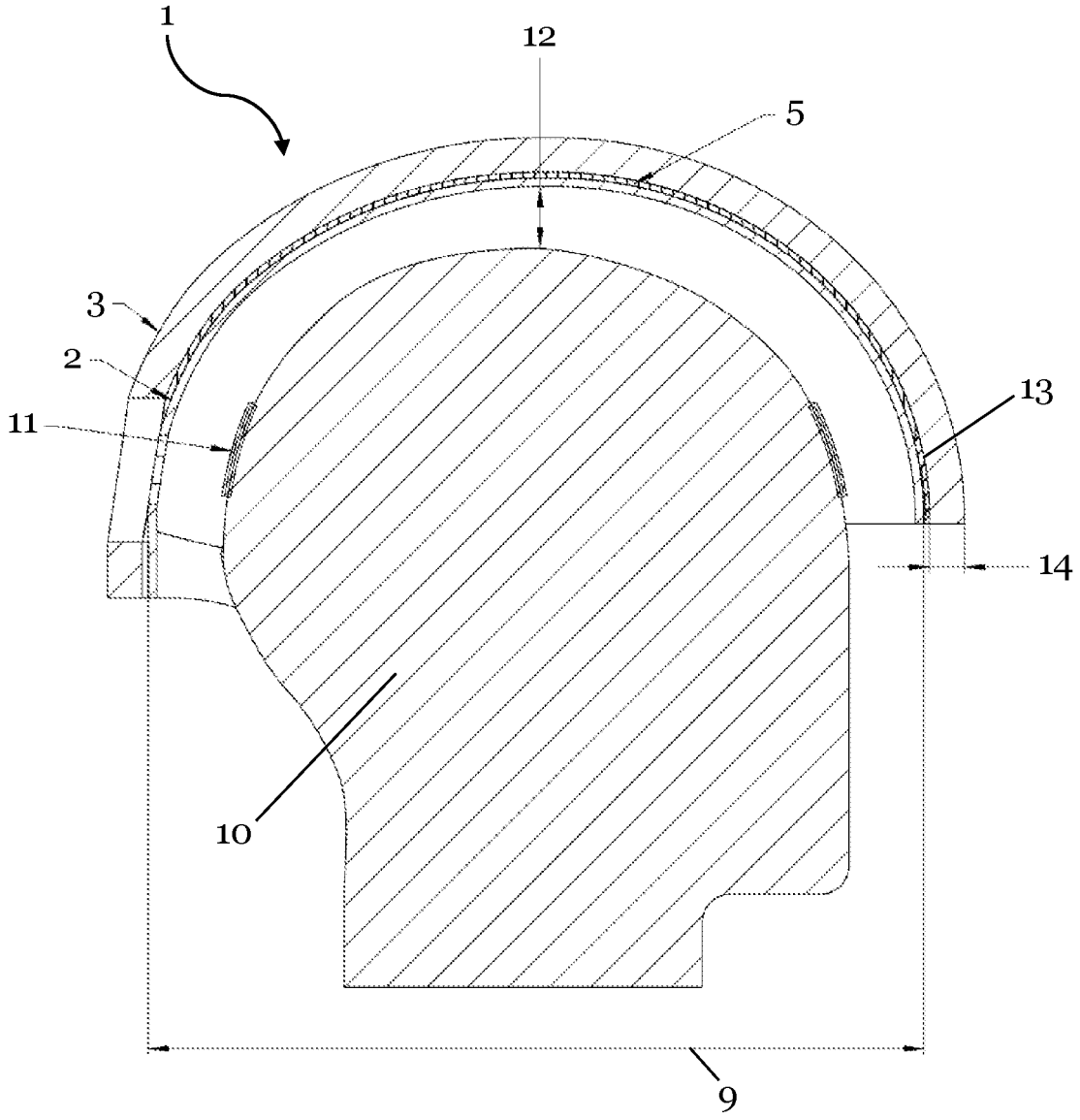

The aspects of the present invention will be explained below on the basis of preferred embodiments with reference to the drawings. The drawings show:

FIG. 1A: a frontal view of an embodiment of a protective helmet according to the invention with a fiber composite layer arranged in the forehead area;

FIG. 1B: a cross-section of the protective helmet shown in FIG. 1A;

FIG. 2A: a frontal view of an embodiment of a protective helmet according to the invention with a fiber composite layer in three parts;

FIG. 2B: a cross-section of the protective helmet shown in FIG. 2A;

FIG. 3A: a frontal view of an embodiment of a protective helmet according to the invention with a fiber composite layer substantially covering the entire helmet dome; and FIG. 3B: a cross-section of the protective helmet shown in FIG. 3A.

5. DETAILED DESCRIPTION OF PREFERRED EMBODIMENTS

FIG. 1A shows a frontal view of an embodiment of a protective helmet 1 according to the invention. FIG. 1B shows a cross-section of the plane designated with reference number A in FIG. 1A, which stands orthogonally on the paper plane. The protective helmet 1 comprises a helmet dome 2 made from metal according to the invention. In the embodiment of FIGS. 1A and 1B, said metal is titanium. Basically, however, other metals such as steel or aluminum may be used as well. The metal may be present as an alloy.

The helmet dome 2 is manufactured in a deep drawing process, preferably from a single-piece titanium sheet. In the embodiment of FIGS. 1A and 1B, the helmet dome 2 is designed in one layer and has a sheet thickness of 1 mm to 5 mm. A multi-layer structure is also possible.

The protective helmet 1 further comprises a layer 3 manufactured from a fiber composite material. A fiber composite material of layers from ultra-high molecular weight polyethylene fibers (UHMW PE) has proven to be particularly advantageous. In a preferred embodiment, aramid fibers are added to said fiber composite material. UHMW PE is a thermoplastic polymer manufactured from very long molecular chains of polyethylene. The individual fibers are of comparatively high specific strength.

The fibers are processed into layers in which the individual fibers are aligned substantially in parallel. Apart from the fibers, such a layer may also comprise a matrix material, for example a resin. For manufacturing the layer 3 in the embodiment of FIGS. 1A and 1B, two or more layers of fibers are joined substantially orthogonally to each other and wound up on a roll. Due to the orthogonal orientation of the molecular chains, a thin layer with high tensile strength in substantially all directions is created. A typical layer thickness is 200 μm. From the thin layer wound up on a roll, cuts are cut out, for example with a CNC cutting machine or a laser, and stapled into a pack. Typically, for this purpose, 70 to 120 thin layers are laid on top of each other and then pressed into a laminate under high pressure of typically 50 to 330 bar and a high temperature of typically 100° C. to 150° C. For this purpose, a heatable press is used. After pressing, the final contour of the layer 3 is cut out from the laminate. In the embodiment, the layer 3 has a thickness 14 of 6 mm to 20 mm.

Basically, other fiber composite materials may also be used in the scope of the present invention, for example comprising aramid fibers. Thermoplastic fibers have proven to be particularly effective in this regard. It is also possible to use mixtures of other types of fibers, such as polyethylene and aramid.

In the embodiment of FIGS. 1A and 1B, the layer 3 comprises a concave surface corresponding to a convex area of the outside 4 of the helmet dome 2, in which the layer 3 is arranged. The contour of the layer 3 thus follows the contour of the helmet dome 2. Between the helmet dome 2 and the layer 3, there is a hook-and-loop strip 5. The layer 3 is thus removably connected to the helmet dome 2. Basically, instead of a hook-and-loop strip, other mounting means may be used as well, such as buttons or magnets, or the layer 3 may be permanently connected to the helmet dome 2, for example by means of an adhesive.

In the embodiment of FIGS. 1A and 1B, the layer 3 has a width 6 of 222 mm and a height 7 of 124 mm. The surface of the layer 3 is 300 $cm^2$ to 500 $cm^2$ by way of example. The protective helmet 1 has a width 8 of 225 mm and a depth 9 of 269 mm. The surface of the helmet is 1000 $cm^2$ to 1500 $cm^2$ by way of example. The shown standard head 10 has size 62. The size specifications, especially the length specifications, only serve as examples. Moreover, according to the invention, the layer 3 does not necessarily have to be arranged in the type of a shield in the forehead region. In other embodiments, the layer is arranged on the sides or in the back part of the head. The layer 3 may also comprise a plurality of elements comprising fiber composite materials, which are arranged next to each other on the helmet dome 2. For example, the protective helmet may comprise a fiber composite layer 3 all around in order to achieve an increased protective effect from all sides.

In other embodiments, two fiber composite layers are arranged in an at least partially overlapping manner, similar to the layer 3 shown in the embodiment of FIGS. 1A and 1B. For example, in areas where primarily direct fire is expected, for example in the forehead area, two fiber composite layers may be arranged in an overlapping manner, whereas in other areas, the helmet dome 2 is covered with only one fiber composite layer.

In the embodiment of FIGS. 1A and 1B, the protective helmet 1 further comprises a headband 11 keeping the helmet dome at a distance 12 from 10 mm to 40 mm, preferably 15 mm to 30 mm to the head 10. Another, optional feature of the helmet 1 is a metal strip 13 arranged at the edge of the forehead area of the helmet under the layer 3 and reinforces the helmet dome there. The metal strip 13 extends from the right to the left temporal area and preferably has a height of approximately 20 mm to 30 mm. The metal strip 13 additionally increases the capability of the helmet 1 to sustain fire in the edge area up to a distance of approximately 15 mm from the edge. The metal strip 13 may be glued onto the helmet dome 2 by means of a two-component adhesive and a glass fiber mat.

FIG. 2A shows a frontal view of another embodiment of a protective helmet 1 according to the invention. FIG. 2B shows a cross-section of the plane designated with reference number B in FIG. 2A, which stands orthogonally on the paper plane. The protective helmet 1 comprises a helmet dome 2 comparable with the helmet dome 2 of the embodiment from FIGS. 1A and 1B. Therefore, the statements made on the embodiment shown in FIGS. 1A and 1B apply with regard to the helmet dome 2.

As opposed to the embodiment of FIGS. 1A and 1B, the protective helmet 1 in the embodiment of FIGS. 2A and 2B comprises a layer of fiber composite material consisting of three segments 3*a*, 3*b* and 3*c*. Segment 3*a* is arranged in the forehead area, segment 3*b* on the right side and segment 3*c* on the left side of the protective helmet 1. The thickness of the layer formed from the three segments 3*a*, 3*b* and 3*c* is 6 mm to 20 mm. With regard to the fiber composite material, basically the statements made on the embodiment of FIGS. 1A and 1B apply.

The three segments 3*a*, 3*b* and 3*c* of the fiber composite layer are connected to the helmet dome 2 via a hook-and-loop strip 5. Other mounting means such as buttons or magnets are possible. In other embodiments, the three segments 3*a*, 3*b* and 3*c* are permanently connected to the helmet dome, for example by means of an adhesive. In other embodiments, some segments may be permanently connected to the helmet dome 2, whereas other segments may be removably connected to the helmet dome 2. For example, the segment 3*a* may be permanently connected to the helmet dome 2 in the forehead area, whereas the lateral segments 3*b* and 3*c* may be removably connected to the helmet dome 2.

The three segments 3*a*, 3*b* and 3*c* do not abut, i.e. a small gap remains between them. In other embodiments, the three segments 3*a*, 3*b* and 3*c* may abut and thus form a continuous layer of fiber composite material. The number of segments in the embodiment of FIGS. 2A and 2B only serves as an example as well. In other embodiments, the protective helmet may comprise two or more than three segments of a layer of fiber composite material.

The protective helmet of the embodiment of FIGS. 2A and 2B has a width 8 of 253 mm and an internal dimension 15 of 225 mm. The depth 9 is 271 mm, and the distance from the inside of the helmet dome 2 to the standard head 10 (size 62) is 15 to 40 mm. In the embodiment of FIGS. 1A and 1B, this distance is caused by a headband 11. The surface of the segments 3*a*, 3*b* and 3*c* is between 300 $cm^2$ and 500 $cm^2$ in this embodiment. The surface of the protective helmet 1 is between 1000 $cm^2$ and 1500 $cm^2$. All aforementioned dimensions are examples and may have other values in other embodiments.

In the embodiment of FIGS. 2A and 2B, the protective helmet 1 also comprises a metal strip 13, to which the statements made on FIGS. 1A and 1B apply.

FIG. 3A shows a frontal view of another embodiment of a protective helmet 1 according to the invention. FIG. 3B shows a cross-section of the plane designated with reference number C in FIG. 3A, which stands orthogonally on the paper plane. The protective helmet 1 comprises a helmet dome 2 comparable with the helmet dome 2 of the embodiments from FIGS. 1A, 1B, 2A and 2B. Therefore, the statements made on the embodiments shown in FIGS. 1A, 1B, 2A and 2B apply with regard to the helmet dome 2.

In the embodiment of FIGS. 3A and 3B, the fiber composite layer 3 is substantially arranged on the entire outside 4 of the helmet dome 2, i.e. the layer 3 substantially completely covers the helmet dome. In this embodiment, the layer 3 is designed as a fiber composite layer in one layer. For manufacturing such a fiber composite layer, the statements made on the embodiments of FIGS. 1A, 1B, 2A and 2B apply.

In the embodiment of FIGS. 3A and 3B, the layer 3 is permanently connected to the underlying helmet dome 2 by means of a connecting layer 5. Such a connecting layer may, for example, be based on an adhesive, such as a two-component adhesive, and a glass fiber mat, where appropriate.

The protective helmet of the embodiment of FIGS. 3A and 3B has a width 8 of 253 mm and an internal dimension 15 of 225 mm. The depth 9 is 269 mm, and the distance from the inside of the helmet dome 2 to the standard head 10 (size 62) is 15 to 40 mm. In the embodiment of FIGS. 1A and 1B, this distance is caused by a headband 11. The height 7 of the helmet is 202 mm. The surface of the protective helmet 1 is between 1000 $cm^2$ and 1500 $cm^2$. All aforementioned dimensions are examples and may have other values in other embodiments.

In the embodiment of FIGS. 3A and 3B, the protective helmet 1 also comprises a metal strip 13, to which the statements made on FIGS. 1A, 1B, 2A and 2B apply.

The protective helmet according to the invention may comprise a visor and/or a neck guard (not shown in the Figures). For this purpose, the protective helmet may comprise one or several mounting means for removably connecting the visor and/or the neck guard to the protective helmet. Alternatively, the visor and/or the neck guard may be firmly connected to the helmet dome.

The protective effect of ballistic protective helmets may, for example, be tested according to the test guideline "bullet-resistant helmet with visor and neck guard" ("Durchschusshemmender Helm mit Visier und Nackenschutz") of the Association of Test Centres for attack-resistant materials and constructions (Vereinigung der Prüfstellen far angriffshemmende Materialien und Konstruktion, VPAM). According to this test guideline, the energy transferred to a measuring head (usually of soap) under fire must not exceed 25 joule. Depending on the caliber and the projectile speed at which this limit is not exceeded, ballistic protective helmets are classified into protection classes. Whereas ballistic protective helmets known in the aft are classified up to protection class 3, an embodiment of the protective helmet according to the invention can be classified into protection class 6 ("VPAM 6"). Specifically, the measuring head was subject to an energy of only 2 joule under fire with caliber 7.62×39 FeC/M43 and a projectile speed of 720 m/s according to VPAM. Such a caliber is typically fired from long guns.

Of course, other residual energies may result in other embodiments of the present invention. Moreover, embodiments of the present invention may also be tested in accordance with other test guidelines and/or norms and/or standards.

The embodiments of the present invention relate to ballistic protective helmets for special forces and policemen. However, the invention is not limited to this but may also be used for protective helmets for military use.

LIST OF REFERENCE SIGNS

1 Protective helmet
2 Helmet dome
3 Fiber composite layer
4 Outside of the helmet dome
5 Mounting means
6 Layer width
7 Height
8 Width
9 Depth
10 Standard head
11 Headband
12 Distance head to the helmet dome
13 Metal strip
14 Layer thickness
15 Internal dimension

The invention claimed is:

1. A ballistic protective helmet, comprising:

a helmet dome formed from a metal material, wherein the helmet dome comprises an inside configured to face a head of a wearer and an opposite outside;

a layer arranged on the outside of the helmet dome, wherein the layer is formed from a fiber composite material, wherein the layer has a thickness of 5 to 30 mm; and a metal strip, which is at least partially arranged in an overlapping manner with the layer and directly connected to the helmet dome, wherein the metal strip is arranged in an edge area in between the helmet dome and the layer, and the metal strip is configured to increase the ballistic protection of the ballistic protective helmet.

2. The ballistic protective helmet according to claim 1, wherein the fiber composite material comprises polyethylene fibers.

3. The ballistic protective helmet according to claim 1, further comprising a first mounting means for removably mounting the layer formed from the fiber composite material to the outside of the helmet dome.

4. The ballistic protective helmet according to claim 3, wherein the first mounting means is arranged in a forehead area of the helmet dome.

5. The ballistic protective helmet according to claim 3, wherein the layer comprises a second mounting means designed such that the layer may be removably mounted to the outside of the helmet dome.

6. The ballistic protective helmet according to claim 1, further comprising a headband having an interior surface spaced at least 10 mm from the inside of the helmet dome, whereby when the protective helmet is being worn, the smallest distance between the inside of the helmet dome and the head of the wearer is at least 10 mm.

7. The ballistic protective helmet according to claim 1, further comprising a headband connected to the helmet dome, wherein the headband keeps the helmet dome at a distance to the head of the wearer when the ballistic protective helmet is being worn.

8. The ballistic protective helmet according to claim 1, wherein the layer comprises a concave surface corresponding to a convex area of the outside of the helmet dome, in which the layer is arranged.

9. The ballistic protective helmet according to claim 1, wherein the metal material is titanium or a titanium alloy.

10. A ballistic protective helmet, comprising:

a helmet dome formed from a metal material, wherein the metal material is titanium or a titanium alloy, and wherein the helmet dome comprises an inside configured to face a head of a wearer and an opposite outside;

a layer arranged on the outside of the helmet dome, wherein the layer is formed from a fiber composite material; and a metal strip, which is at least partially arranged in an overlapping manner with the layer and directly connected to the helmet dome, wherein the metal strip is arranged in an edge area in between the helmet dome and the layer, and the metal strip is configured to increase the ballistic protection of the ballistic protective helmet.

11. The ballistic protective helmet according to claim 10, comprising a first mounting means arranged on the outside of the helmet dome for removably mounting the layer to the outside of the helmet dome.

* * * * *